United States Patent [19]

DiGiacomo

[11] 4,070,849

[45] Jan. 31, 1978

[54] METHOD OF FORMING WALLS FOR POOLS, WATERFALLS AND THE LIKE

[76] Inventor: Philip A. DiGiacomo, 13246 Chandler Blvd., Van Nuys, Calif. 91401

[21] Appl. No.: 646,243

[22] Filed: Jan. 2, 1976

[51] Int. Cl.[2] ..... E04B 21/02

[52] U.S. Cl. ..... 52/742; 264/31; 264/233; 249/DIG. 3

[58] Field of Search ..... 52/742, 169, 314; 61/35, 39; 264/31, 333, 336, 337, 225, 226, 34, 35; 249/10–12, 112, 140, DIG. 3

[56] References Cited

U.S. PATENT DOCUMENTS

| | | | |
|---|---|---|---|
| 3,031,801 | 5/1962 | Leuthesser | 52/169 |
| 3,177,279 | 4/1965 | Bilodeau | 52/314 |
| 3,475,265 | 10/1969 | Santry | 264/337 |
| 3,515,779 | 2/1970 | Jones | 264/316 |
| 3,610,564 | 10/1971 | Mattingly | 52/169 |
| 3,643,394 | 2/1972 | Johnson | 52/314 |
| 3,768,266 | 10/1973 | Glenn | 61/39 |
| 3,844,527 | 10/1974 | Scott | 249/112 |
| 3,854,265 | 12/1974 | Kobayashi | 52/742 |

OTHER PUBLICATIONS

Urquhart and O'Rourke, Design of Concrete Structures, McGraw-Hill Book Company, Inc., New York, 1940, pp. 16–25.

*Primary Examiner*—James L. Ridgill, Jr.
*Attorney, Agent, or Firm*—Blakely, Sokoloff, Taylor & Zafman

[57] ABSTRACT

A method of forming walls for pools, waterfalls and the like having surfaces accurately simulating material surfaces, such as rock surfaces. The method is comprised of the steps of coating a rock surface to be simulated with latex, coating the latex with urethane resin, and allowing the resin to foam in place. The urethane foam-latex member is then removed from the rock to be simulated and is used as one wall of the pouring form for forming the corresponding wall of the pool, etc. In the case of swimming pools, a trench in the position of the desired walls of a pool can be dug with the inner surfaces of the trench provided with the foam-latex panels for forming the simulated rock surface on the resulting pool walls. Alternate embodiments and methods of practicing the invention are disclosed.

6 Claims, 10 Drawing Figures

Fig. 2
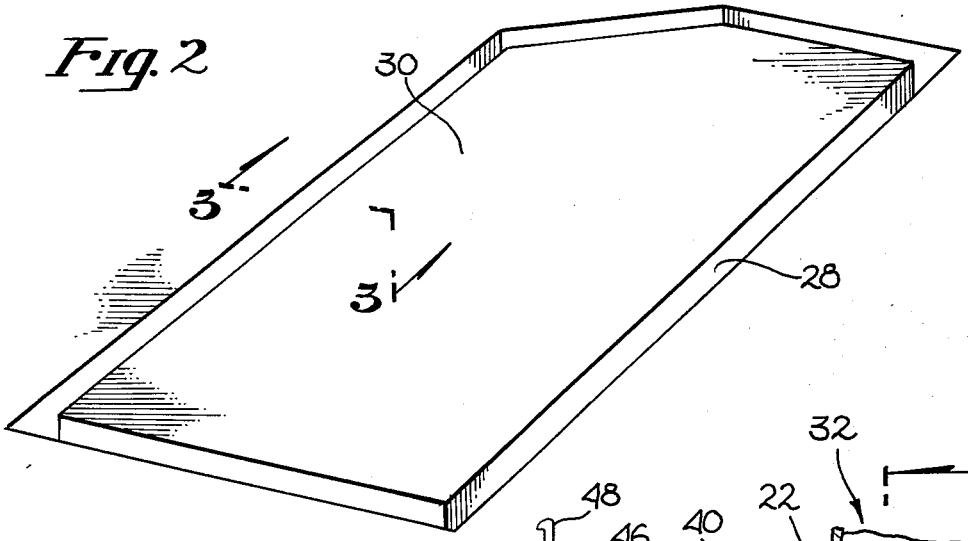
Fig. 1
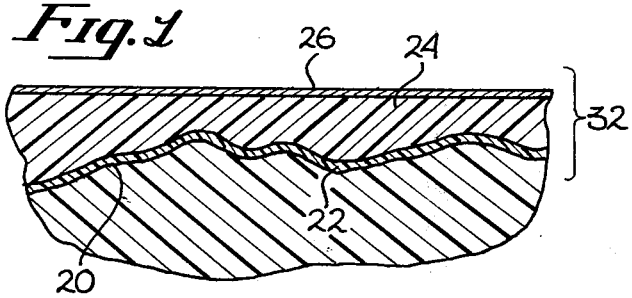
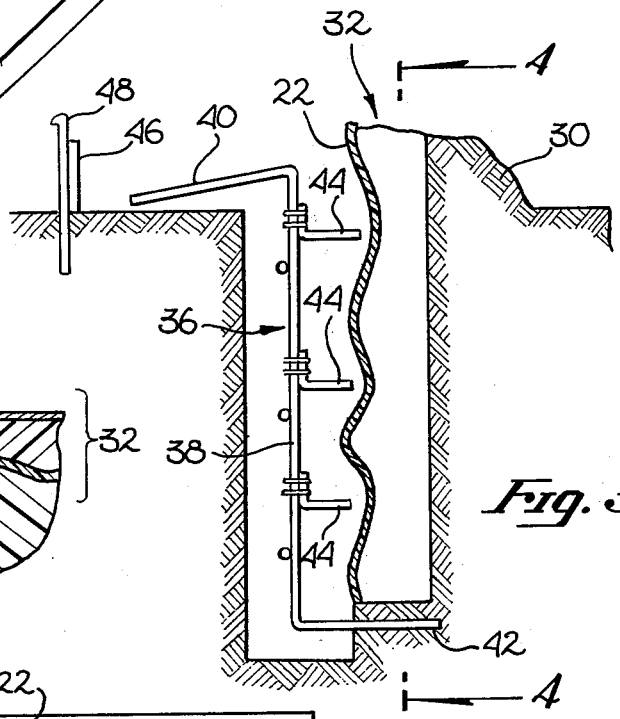
Fig. 3
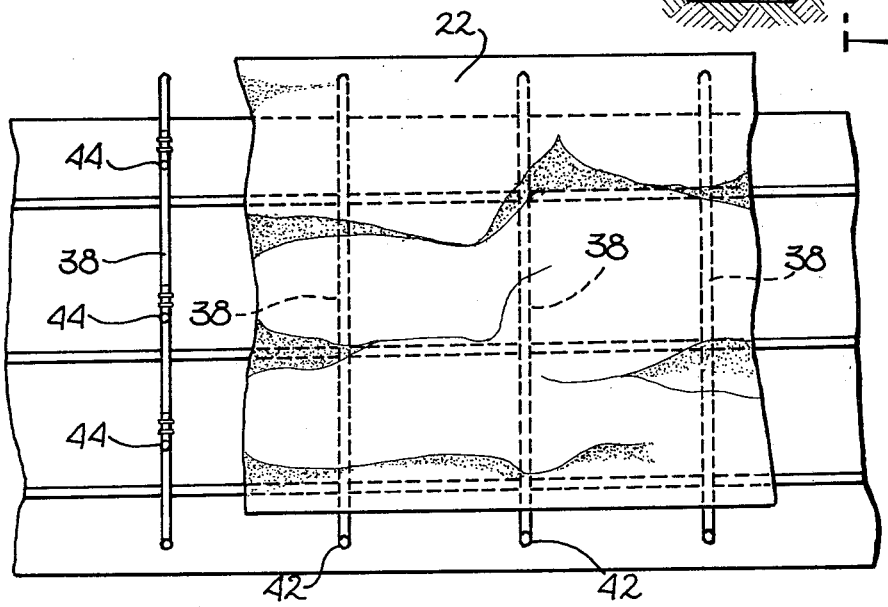
Fig. 4

METHOD OF FORMING WALLS FOR POOLS, WATERFALLS AND THE LIKE

BACKGROUND OF THE INVENTION

1. Field of the Invention

The present invention relates to the field of construction, and more particularly the construction of walls, facings and the like, such as in swimming pools, simulating natural rock or other decorative surfaces.

2. Prior Art

Rock walls and the like have been used as decorative facings for various types of structures for many years. Historically such walls have been constructed from natural rock and mortar, generally abutting a structural wall of some kind to provide a decorative surface or finish therefor. In recent years however, the cost of locating and transporting natural rock of suitable size and character for such purposes has rapidly increased, and accordingly various techniques have been utilized to simulate rock surfaces and the like, utilizing materials other than natural rock. Fiberglass panels simulating rock and mortar, and molded concrete rock and mortar walls are examples.

The particularly attractive ornamental appearance of natural rock surfaces has created a demand for the accurate simulation of such surfaces in new applications; such as by way of example, swimming pool walls. Such applications may require the simulation of rock surfaces of greater area, of various overall shapes, and of greater structural requirements. For cost and structural reasons, such applications may preclude the separate casting of individual concrete rocks and the placement of the individual molded rocks utilizing mortar to achieve the desired results. Accordingly, techniques have been developed and are known in the prior art for molding complete walls simulating rock surfaces.

One technique for simulating rock surfaces which is known in the prior art is to coat a suitable natural rock surface with liquid latex so as to provide a latex imprint of fine detail duplicating the rock surface. A number of latex coatings may be used to provide an overall thickness of latex sufficient to provide a relatively durable latex sheet giving a high degree of detail for the rock surface. This latex sheet may then be pealed away from the natural rock and supported at the location of the desired simulated rock surface for coating with concrete, gunnite or the like to provide this simulated surface.

While the latex sheet as hereinbefore described provides an accurate duplication of the natural rock surface to be simulated, it must be suitably supported before concrete or gunnite may be applied to the surface thereof. Thus various types of support have been utilized in the prior art. By way of example, soil may be utilized to support the latex sheet in the desired position which, depending upon its characteristics, may be sufficiently self-supporting to allow the vertical disposition of the latex sheet in the desired position prior to the pouring of concrete or the application of the gunnite. Other materials such as sand provide a better support for the detail on the latex sheet, though because of its lack of self-supporting characteristic, the sand on one side of the latex sheet is best added as the concrete or gunnite is applied to the opposite side of the sheet.

Another material which has been used in the prior art (U.S. Pat. No. 3,950,477, issued to the present inventor) is foam plastic pellets such as the foam plastic materials commonly used for packing materials. Such materials are very light and accordingly are very easily disposed behind the latex sheet without distorting the sheet. Also these pellets may have interlocking characteristics so as to bind rather than flow under pressure, thereby enhancing their ability to support the loads of cast concrete and gunnite. They have the disadvantage however of not providing the very finely distributed and uniform support, and accordingly may result in greater local irregularity in the simulated surface than desired. Also none of the foregoing materials provides the form and support of the latex sheet in the same shape in which it was originally formed on the natural rock surface, and accordingly the resulting distortion and reorientation of the latex results in some loss in detail in the simulated surface. Also these support materials are in turn not easily supported at the construction site, resulting in considerable hand labor during construction, and substantial variation during the practicing of the various methods.

BRIEF SUMMARY OF THE INVENTION

A method of forming walls for pools, waterfalls and the like having surfaces accurately simulating natural surfaces such as rock surfaces or brick surfaces. The method is comprised of the steps of coating a rock surface to be simulated with latex, typically a number of layers of latex, and then coating the latex with urethane resin and allowing the resin to foam in place. The urethane foam latex member is then removed from the rock to be simulated, and is used as one wall of the pouring form for forming the corresponding wall of the pool, etc. In the case of swimming pools, the urethane foam latex members may be braced in position from the center of the pool excavation. However, another method found to be particularly useful is to provide a trench in the position of the desired walls of a pool, with the inner surfaces of the trench provided with the foam latex panels for forming the simulated rock surface on the resulting pool walls. This automatically provides backing for the mold panels, and a trench of sufficient width may be used to allow access for a workman to set the steel reinforcing before the molds are placed in position. Alternate embodiments and methods of practicing the invention are disclosed.

BRIEF DESCRIPTION OF THE DRAWINGS

FIG. 1 is a view showing a natural surface to be simulated with a cross-section of the urethane foam latex mold panel formed thereabove.

FIG. 2 is a prospective view of the region within which a swimming pool is to be formed, showing a trench at the desired locations of the swimming pool walls.

FIG. 3 is a cross-section of the trench of FIG. 2 taken along lines 3—3 of FIG. 2, showing the mold panel in place and a rebar network in the trench.

FIG. 4 is a partial cross-sectional view taken along line 4—4 of FIG. 3.

DETAILED DESCRIPTION OF THE INVENTION

Figure 5:
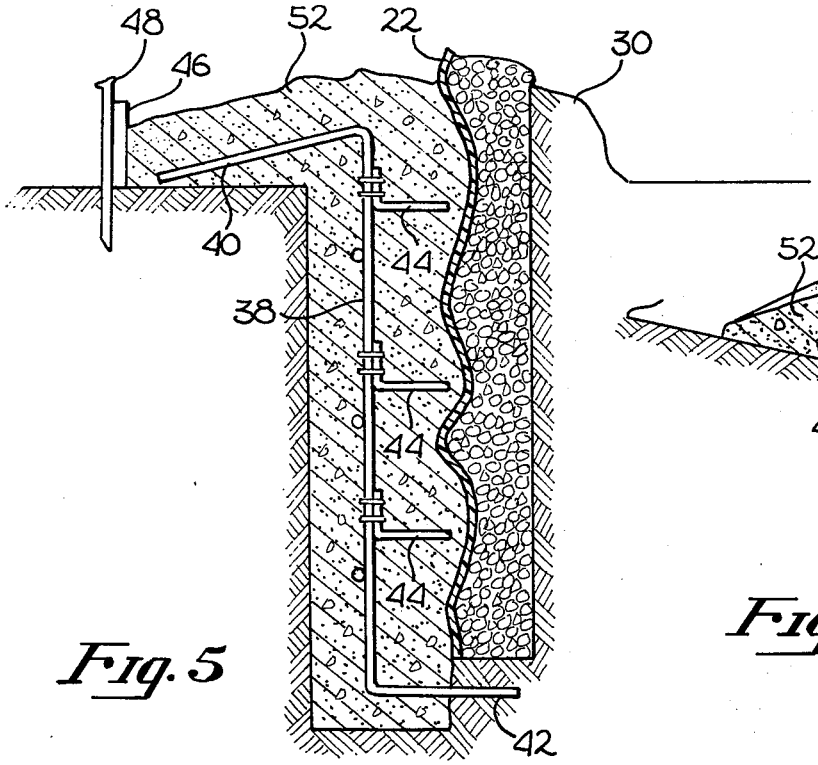
FIG. 5 is a cross-section similar to FIG. 4 after the cementitious material has been placed in position.
Figure 6:
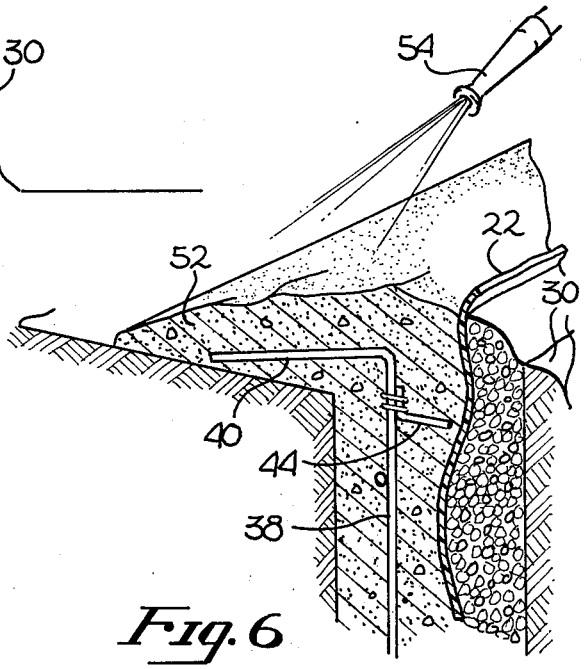
FIG. 6 is a prospective cross-sectional view of part of the trench of FIG. 5 illustrating the manner in which the coping region is allowed to slump and the spraying thereof with water.

The present invention comprises methods for providing walls, facings and the like duplicating a natural surface such as by way of example, a natural rock surface. It is particularly suited to the construction of swimming pools wherein the inner walls of the swimming pools duplicate or simulate a natural rock surface, and accordingly in the description to follow, the details of the present invention shall be described with respect to the construction of such swimming pools. However, it is to be understood that the present invention may readily be used for the construction of walls and facings simulating natural surfaces, such as rock, or even brick surfaces, and may also readily be used to fabricate smaller water holding enclosures, such as spas, therapy pools, whirlpools, hot tubs and the like.

The first step in practicing the present invention is to provide suitable molds for duplicating the surface to be simulated. One aspect of the present invention is to form mold members which are relatively self-supporting so that they may be quickly and accurately disposed at the desired location for forming the desired wall, typically by pouring concrete or placing gunnite thereagainst. Thus as may be seen in FIG. 1, a natural surface such as rock surface 20 is selected for simulation, and cleaned to remove dirt and loose particles therefrom. Then a release agent such as a liquid soap, or castor oil dilluted with alcohol, is applied to the surface 20 so that the latex mold to be formed thereover may be readily separated from the surface. The surface 20 is then coated with a layer of liquid latex so that the latex when dry will accurately duplicate the unique character and surface texture of the surface 20, as well as the general geometric shape thereof. Accordingly, the release agent should be used sparingly enough to avoid obscuring the surface detail of surface 20, and the liquid latex, preferably one of low shrinkage, should be applied by a brush or other means so as to encourage the latex to follow the fine detail of the surface. Air bubbles should be avoided, and latex of sufficient viscosity should be used so as to allow the uniform application of latex. Additional coats of liquid latex will provide the progressive build-up in latex thickness, preferably to a range of approximately one-eighth of an inch to three-sixteenths of an inch. If desired the latex may be reinforced by applying strips or a layer of cheesecloth, burlap, fiberglass screening or the like between layers of latex, and thoroughly soaking these materials in the latex before it dries to integrate the reinforcing into the finished latex mold. Note that latex or material with similar properties such as vinyl or rubber may be employed to form this mother mold.

Following the formation of the latex mold layer the latex is coated with a foaming plastic resin, preferably a polyurethane resin, which is then allowed to foam in place to provide the back-up support for the latex mold surface conforming to the surface being stimulated. For this purpose it is preferable to use a urethane foam having a closed cell structure and preferably at least a semi-rigid foam so as to avoid unnecessary water absorption in later use and to provide sufficient support against the typical hydrostatic pressures to which the mold may be subjected when molding swimming pool walls and the like. If desired, the resulting foam 24 (FIG. 1) may be backed up with plywood 26 to define a flat surface at the back of the mold panel and to protect the foam against physical damage during subsequent handling and use. Other material such as fiberglass may be employed to form this support mold.

After the foam has cured, the mold panel comprising the foam backed latex sheet is removed from the surface 20 to be duplicated, and after trimming its periphery if needed, is ready for use in molding a surface simulating the surface 20.

Now referring to FIG. 2, a novel method of constructing swimming pools which may utilize the present invention may be seen. In this method the position of the swimming pool walls is laid out and a trench 28 is provided at the desired location of the walls typically by a suitable trencher. The earth in the central region of the pool 30, however, is left in place, at least temporarily, so that the walls of the pool may be molded within the trench 28 with the central earth 30 providing the back-up or support for the mold panels 32. Obviously the trench 30 should be of varying depths dependent upon the local depth of the finished pool, ranging perhaps from three to perhaps 8 to 10 feet in a typical installation. Also since the trench 28 will form not only the walls of the pool, but also will accommodate the thickness of the mold panel 32, a trench width on the order of approximately two feet is appropriate, depending upon the thickness of the mold panel 32. Such a trench width will allow an individual to work within the trench for such purposes as contouring the trench bottom as may be necessary, and for setting reinforcing within the trench prior to the pouring of the concrete in the trench.

Now referring to FIGS. 3 and 4, a side view of the trench 28 and a view taken along line 4—4 of FIG. 3, respectively, may be seen. The mold panel 32 is disposed against the earth in the central region 30 of the pool, with the latex layer 22 facing outward to define a mold for concrete between the latex 22 and the outer wall 34 of the trench. Also disposed within the trench is a network of steel reinforcing bar ("re-bar") generally identified by the numeral 36. This re-bar network is similar to that used in prior art pools and comprises horizontal runs as well as vertical runs 38 to define a re-bar matrix within the trench. The vertical runs 38, however, extend upward the trench and are bent at the top thereof to form the downward and outward projecting sections 40 which, as shall subsequently be seen, form part of the reinforcement for the integrally cast coping of the pool (adjacent the outer ends of these rebar sections is provided a temporary wooden boundary form 46, temporarily held in place by stakes 48). Also the lower ends of the vertical runs 38 are bent at an angle of approximately ninety degrees to form inward projecting sections 42, which preferably are disposed in the earth under the mold panel 32 so as to provide tie points for the re-bar network to reinforce the bottom of the pool, to be formed in subsequent operations. In addition there may also be provided inwardly projecting re-bar members 44 which may be used as reinforcing for any sections of the pool wall which may need any additional local reinforcement, such as may be required for a wall or a surface as is illustrated being constructed in FIG. 9.

Now referring to FIG. 5, a cross section of the trench similar to FIG. 3 but after filling may be seen. The trench is filled with concrete or gunnite 50, taking care to avoid air bubbles in the concrete to assure complete filling of the trench and good duplication of the detail on the surface of the latex 22. Tamping or vibrating may be advantageously employed. The trench is somewhat overfilled with the concrete 50, with the outward extending portion 52 surrounding re-bar members 40 and extending to the members 46 to provide an approximate definition of what will subsequently become the integrally cast coping for the pool. In the preferred method of practicing the present invention, the concrete is allowed to partially cure, but before setting to a hard condition the stakes 48 and barrier 46 are removed to allow the concrete at the outer periphery of the coping to slump somewhat, thereby providing a free form periphery for the pool, yet avoiding thin and structurally unsound edges for the coping. Further, in the preferred embodiment the coping is sprayed with water through a conventional hose and nozzle 54 to enhance the resulting natural texture and contour of the coping. In the preferred manner of practicing the invention, it has been found most preferable to allow the concrete to set for approximately thirty minutes before allowing the coping region to slump, and to spray the coping region with water approximately thirty minutes after it has been allowed to slump. This combination provides for sufficient slump to break up the otherwise well defined geometric periphery of the pool without allowing so much slump as to result in thin and structurally unsound sections and to allow enhancement of the visual effect by spraying in a controlled manner.

Figure 7:
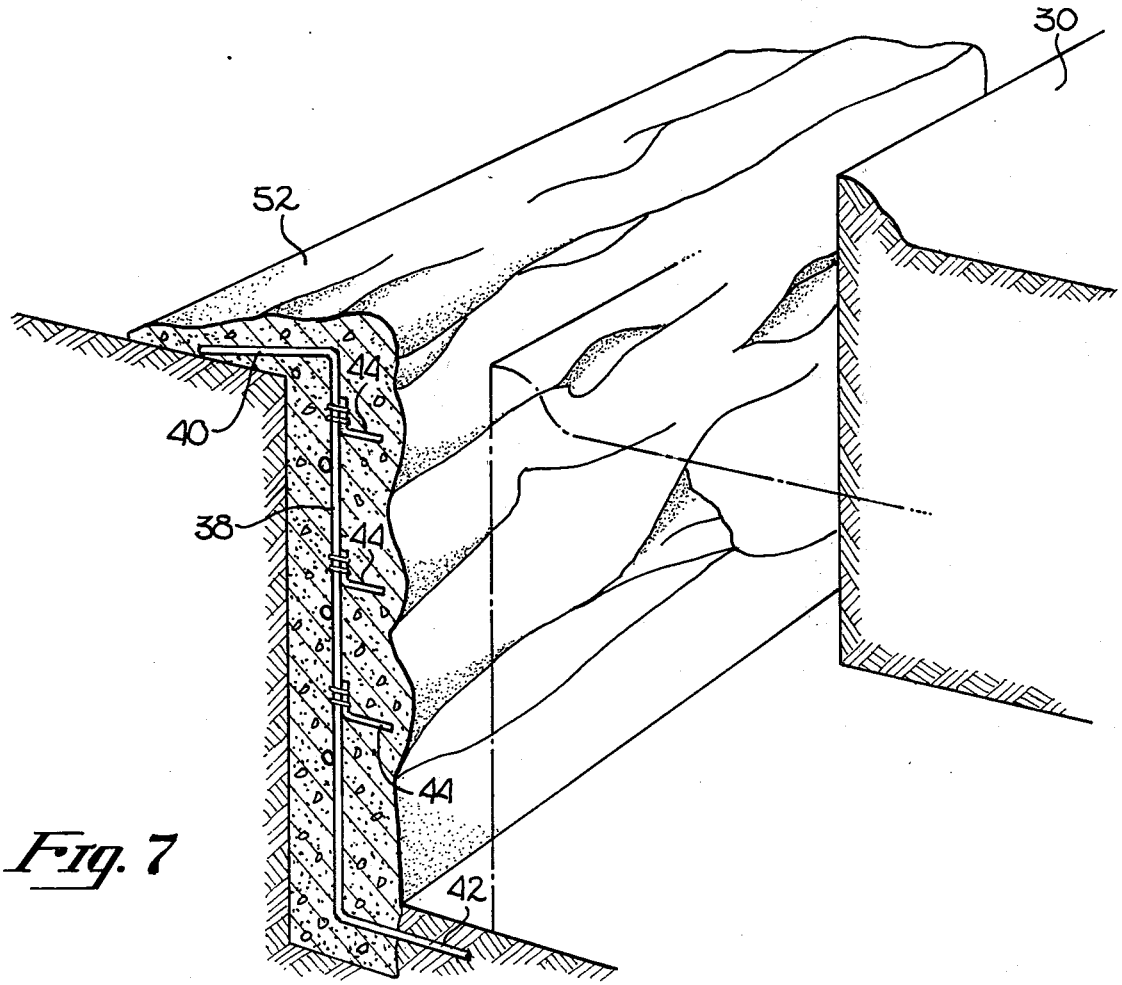
FIG. 7 is a perspective cross-sectional view similar to FIG. 6 after the mold panel and part of the central earth region have been removed.

After the pool walls have been allowed to cure, the earth at the center of the pool 30 (FIGS. 2 and 7) may be removed so as to expose the lower sections of re-bar 42. Thereafter, an additional re-bar network may be tied into these projecting re-bar sections and the bottom of the pool poured, typically with a flat or smooth finish.

Figure 8:
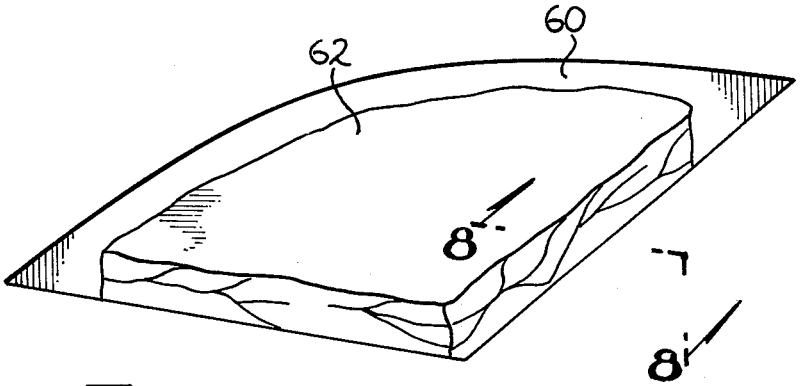
FIG. 8 is an illustration of an alternate embodiment showing the trenching which might be used for the formation of a spa.
Figure 9:
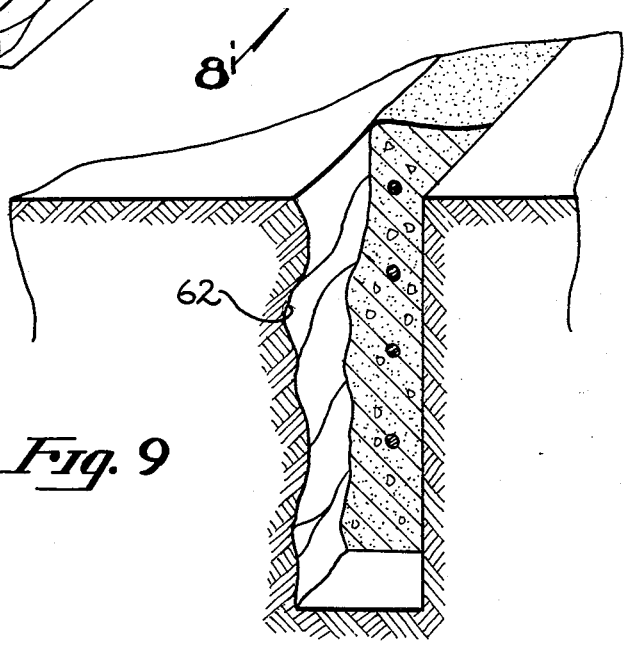
FIG. 9 is a cross-sectional view taken along line 9—9 of FIG. 8 after the inner surface of the trench has been sculptured and the trench filled with cementitious material.

Now referring to FIGS. 8 and 9, an alternate method of forming the decorative walls of a water containing enclosure may be seen. In FIG. 8 a trench 60 has been dug to define the periphery of a spa. Thereafter the inner wall 62 of the trench is sculptured in accordance with the desired decorative effect to form the mold surface which in turn will define the characteristics of the inner periphery of the concrete spa walls. Thereafter the reinforcing is put into place, the concrete poured, etc. as before, with the subsequent removal of the central earth region 62 exposing the contoured or sculptured walls of the spa for finishing by painting, plastering or the like to provide the desired finished texture and appearance. While the extent of duplication or simulation of rock or other decorative surfaces obtainable in this manner is not as great as with the hereinbefore described method, the cost of providing decorative walls for pools and the like by this method is substantially lower, and the method is highly useful for providing decorative walls to pools and the like at a reasonable cost.

Figure 10:
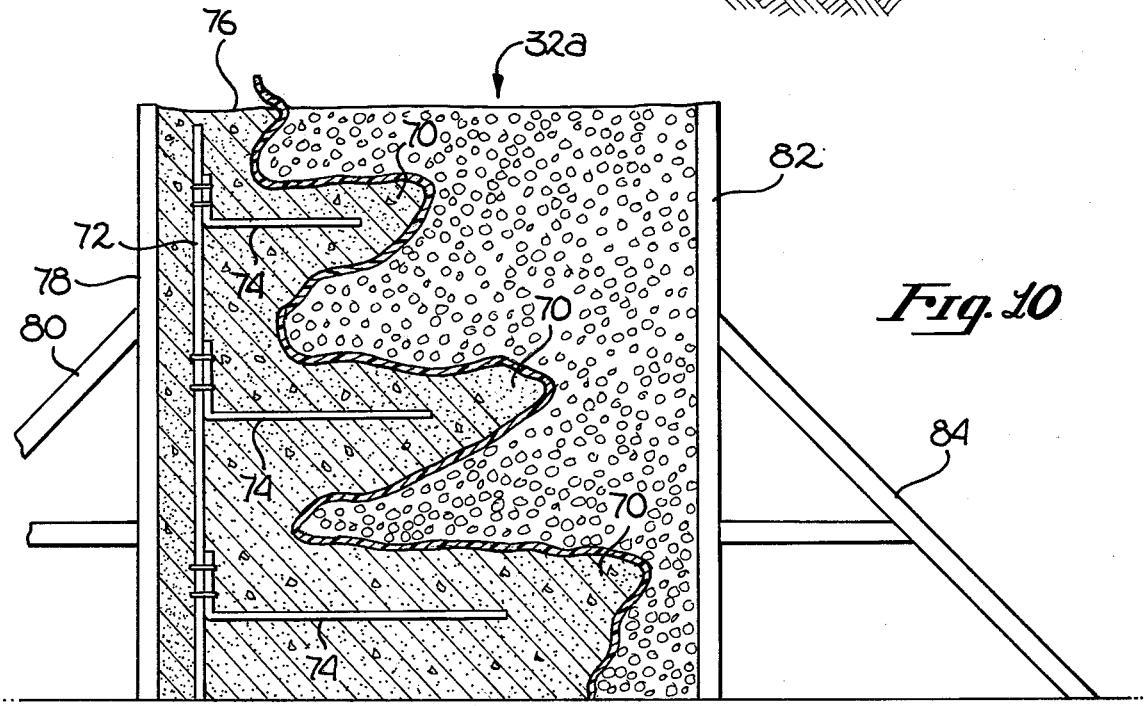
FIG. 10 is a cross-sectional view of a mold set up for molding a waterfall with a rock face having accentuated rock segments.

Now referring to FIG. 10, a method for fabricating walls or surfaces of more pronounced contours utilizing the present invention is illustrated. In particular in FIG. 9, a cross section illustrating the manner of forming a vertical surface of a waterfall is illustrated. In this situation the mold panel **32*a* has been fabricated using either a rocky surface of more pronounced contour, or a surface defined by a plurality of individual rocks defining a plurality of projections 70. The reinforcing 72 is provided with appropriately disposed and extending horizontal members 74 for reinforcing each of the projections to be formed by the concrete 76 so that the finished structure will resist cracking during handling or inadvertent mishandling or abuse. Where natural boundaries are not provided a temporary retaining wall 78 supported by supports 80 may be used to define the back wall of the mold, with a similar wall 82 supported by supports 84 supporting the mold panel 32*a***.

There has been described herein a method of forming a mold surface simulating a natural surface such as a rock surface, and methods of forming walls for pools, waterfalls and the like which simulate natural surfaces such as rock surfaces. The methods of utilizing the present invention specifically described herein are described for purposes of example only, as alternate methods of constructing walls and the like using the forms of the present invention may readily be employed by those of ordinary skill in the art from the disclosure herein given. Thus, while the present invention has been described with respect to certain preferred methods of practicing the invention, it will be readily understood by those skilled in the art that various changes in form, detail and method of practice may be made without departing the spirit and scope of the invention.

I claim:

1. A method of simulating a natural rock surface comprising the steps of:

a. applying a material on the surface of said natural rock to form a mother mold having a surface form conforming to said surface of said natural rock;

b. applying polyurethane to said mother mold such that said polyurethane foams in place to form a mold panel, said polyurethane supporting said mother mold against hydrostatic pressures such that said surface form of said mother mold conforming to said natural rock surface does not distort, said mold panel being constructed of a closed cell semi rigid foam so as to avoid unnecessary water absorption and to provide sufficient support against typical hydrostatic pressures to which the mold may be subjected.

c. removing said mold panel from said natural rock surface;

d. supporting said mold panel with the exposed face of said mold in the desired location of the simulated surface;

e. providing a cementitious material against said exposed face of said mother mold; and f. removing said mold panel after the cementitious material has cured;

whereby a natural rock may be simulated including many of the natural details.

2. The method of claim 1 wherein said mother mold comprises latex.

3. A method of forming pool walls simulating rock surfaces and the like comprising the steps of:

a. digging a trench in the outline of the pool walls to be formed;

b. providing mold panels formed by the steps of:

1. applying liquid latex on the surface to form a rubber film having a surface form conforming to the surface to be simulated;

2. applying polyurethane resin to the rubber film and allowing the resin to foam in place to form a rubber film-urethane foam mold panel, said support material supporting said mother mold against hydrostatic pressures such that said surface form of said mother mold conforming to said surface to be simulated does not distort;
3. removing the mold panel from the surface to be simulated.

c. disposing the mold panels in the trench adjacent the inner wall thereof with the latex surface facing outward;
d. providing a steel reinforcing network in the trench;
e. positioning the bottom of said network such that bars penetrate the earth adjacent the bottom of said trench at points spaced above said bottom of said trench to form reinforcing tie points for a pool bottom;
f. filling the remainder of the trench adjacent the mold panels with a cementitious material to form the pool walls;
g. removing the earth within the pool walls after the cementitious material has cured;
h. removing the mold panels and;
i. forming said pool bottom which connects with said reinforcing tie points.

4. The method of claim 3 further including the integral formation of coping around the pool wall wherein a removable barrier is placed around the trench at ground level, step (f) includes the filling of the trench to an extent to cause some cementitious material to abut the barrier, the barrier being subsequently removed to allow the cementitious material to slump prior to its curing to a rigid state to form the coping.

5. The method of claim 4 further comprising the step of spraying the coping region with water after it is allowed to slump and before it fully cures.

6. The method of claim 4 wherein the cementitious material is cement, and said cement in the coping region is allowed to cure for approximately one half hour before it is allowed to slump.

* * * * *